US011920847B2

(12) United States Patent
Mitchell et al.

(10) Patent No.: US 11,920,847 B2
(45) Date of Patent: Mar. 5, 2024

(54) ICEMAKING APPLIANCE HAVING A REPLACEABLE FILTER

(71) Applicant: Haier US Appliance Solutions, Inc., Wilmington, DE (US)

(72) Inventors: Alan Joseph Mitchell, Louisville, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 138 days.

(21) Appl. No.: 17/357,066

(22) Filed: Jun. 24, 2021

(65) Prior Publication Data

US 2022/0412630 A1 Dec. 29, 2022

(51) Int. Cl.
*F25C 5/182* (2018.01)
*F25C 1/22* (2018.01)

(52) U.S. Cl.
CPC ..... *F25C 5/182* (2013.01); *F25C 1/22* (2013.01); *F25C 2400/12* (2013.01); *F25C 2400/14* (2013.01); *F25C 2500/08* (2013.01)

(58) Field of Classification Search
CPC ..... F25C 5/182; F25C 1/22; F25C 2400/12; F25C 2400/14; F25C 2500/08; F25C 1/045; F25C 1/12; F25C 1/18; B61D 35/027; B61D 59/30; F25D 2323/121; B01D 35/027; B01D 59/30
See application file for complete search history.

(56) References Cited

U.S. PATENT DOCUMENTS

| | | | | |
|---|---|---|---|---|
| 6,241,893 | B1 | 6/2001 | Levy | |
| 7,591,399 | B2 | 9/2009 | Boarman | |
| 10,274,238 | B2 | 4/2019 | Mitchell | |
| 10,336,629 | B2 | 7/2019 | Mitchell | |
| 2014/0083924 | A1* | 3/2014 | Bergendal | C02F 1/003 210/451 |
| 2016/0334157 | A1* | 11/2016 | Broadbent | F25C 5/20 |
| 2020/0224949 | A1* | 7/2020 | Kandi | F25C 5/22 |

FOREIGN PATENT DOCUMENTS

| | | | | |
|---|---|---|---|---|
| EP | 2816303 | A2 | 12/2014 | |
| KR | 20170143296 | * | 12/2017 | F25D 17/042 |

OTHER PUBLICATIONS

English language translation of KR 10-2017-0143296. Translated Jun. 2023 (Year: 2017).*

* cited by examiner

*Primary Examiner* — Cassey D Bauer
(74) *Attorney, Agent, or Firm* — Dority & Manning, P.A.

(57) ABSTRACT

An icemaker appliance includes a cabinet forming an ice storage compartment, an ice maker provided in the ice storage compartment, a first reservoir storing liquid, a filter nested within the first reservoir, and a circulation system to deliver the liquid from the first reservoir to the ice maker. The liquid not frozen on the ice maker is filtered through the filter and resupplied to the circulation system.

20 Claims, 7 Drawing Sheets

ICEMAKING APPLIANCE HAVING A REPLACEABLE FILTER

FIELD OF THE INVENTION

The present subject matter relates generally to icemaker appliances, and more particularly to stand alone icemaker appliances with gravity filtration systems.

BACKGROUND OF THE INVENTION

Icemaker appliances generally include an ice maker that is configured to generate ice. Ice makers within icemaker appliances are plumbed to a water supply, and water from the water supply may flow to the ice maker within the icemaker appliances. Icemaker appliances are frequently cooled by a sealed system, and heat transfer between liquid water in the ice maker and refrigerant of the sealed system generates ice.

In certain icemaker appliances, stored ice within the icemaker appliances melts over time and generates liquid meltwater. Commonly, the icemaker appliances are plumbed to an external drain (e.g., connected to a municipal water system) to dispose of the liquid meltwater. While effective for managing the liquid meltwater, external drain lines have drawbacks. For example, external drain lines can be expensive to install. In addition, external drain lines can be difficult to install in certain locations. Additionally, cleaning such icemaker appliances can be burdensome and time consuming.

Additionally or alternatively, certain icemaker appliances incorporate plumbed filters to filter out contaminants within the water supplied to the ice maker. These filters are typically plumbed, having an inlet and an outlet through which the water is pumped in order to remove the contaminants. However, plumbed filters have certain drawbacks. For example, plumbed filters exhibit large pressure drops, resulting in decreased efficiency in pumps and increased cost for operation. Further, the required high-pressure pumps for pumping water through the plumbed filters produce excessive noise and may create undesirable operating conditions.

Accordingly, an icemaker appliance that obviates one or more of the above-mentioned drawbacks would be useful. In particular, an icemaker appliance with a more efficient filtration process would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an icemaker appliance is disclosed. The icemaker appliance may define a vertical direction, a lateral direction, and a transverse direction. The icemaker appliance may include a cabinet forming an ice storage compartment; an ice mold provided within the cabinet; a first reservoir provided below the ice mold and configured for collecting liquid from the ice mold; a filter nested within the first reservoir; and a circulation system in fluid communication with the first reservoir. The circulation system may include a circulation conduit; a first pump connected to the circulation conduit to pump the liquid through the circulation conduit; and a nozzle downstream from the circulation conduit to dispense the liquid from the circulation conduit, wherein the liquid dispensed from the nozzle falls onto the filter.

In another exemplary aspect of the present disclosure, an icemaker appliance is disclosed. The icemaker appliance may include a cabinet forming an ice storage compartment; a first reservoir provided within the ice storage compartment, the first reservoir configured to receive a liquid; a removable grate located within the ice storage compartment over the first reservoir; an ice maker provided within the ice storage compartment to produce ice; a filter nested within the first reservoir, wherein the liquid within the first reservoir permeates through the filter; and a circulation system in fluid communication with the first reservoir. The circulation system may include a circulation conduit; a pump connected to the circulation conduit to pump liquid from the first reservoir through the circulation conduit; and a nozzle downstream from the circulation conduit to dispense the liquid from the circulation conduit toward the ice maker.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
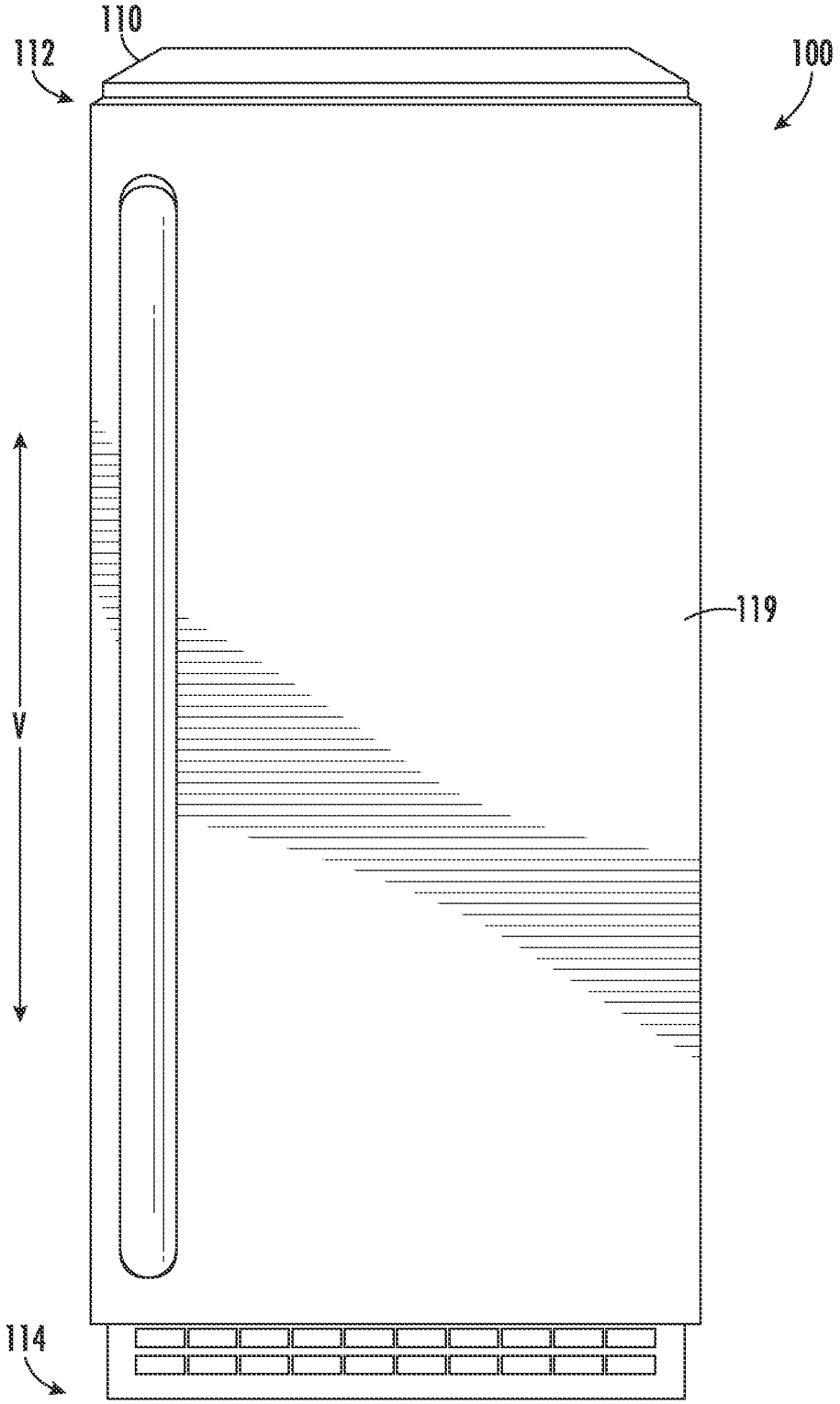
FIG. 1 provides a front, perspective view of an icemaker appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
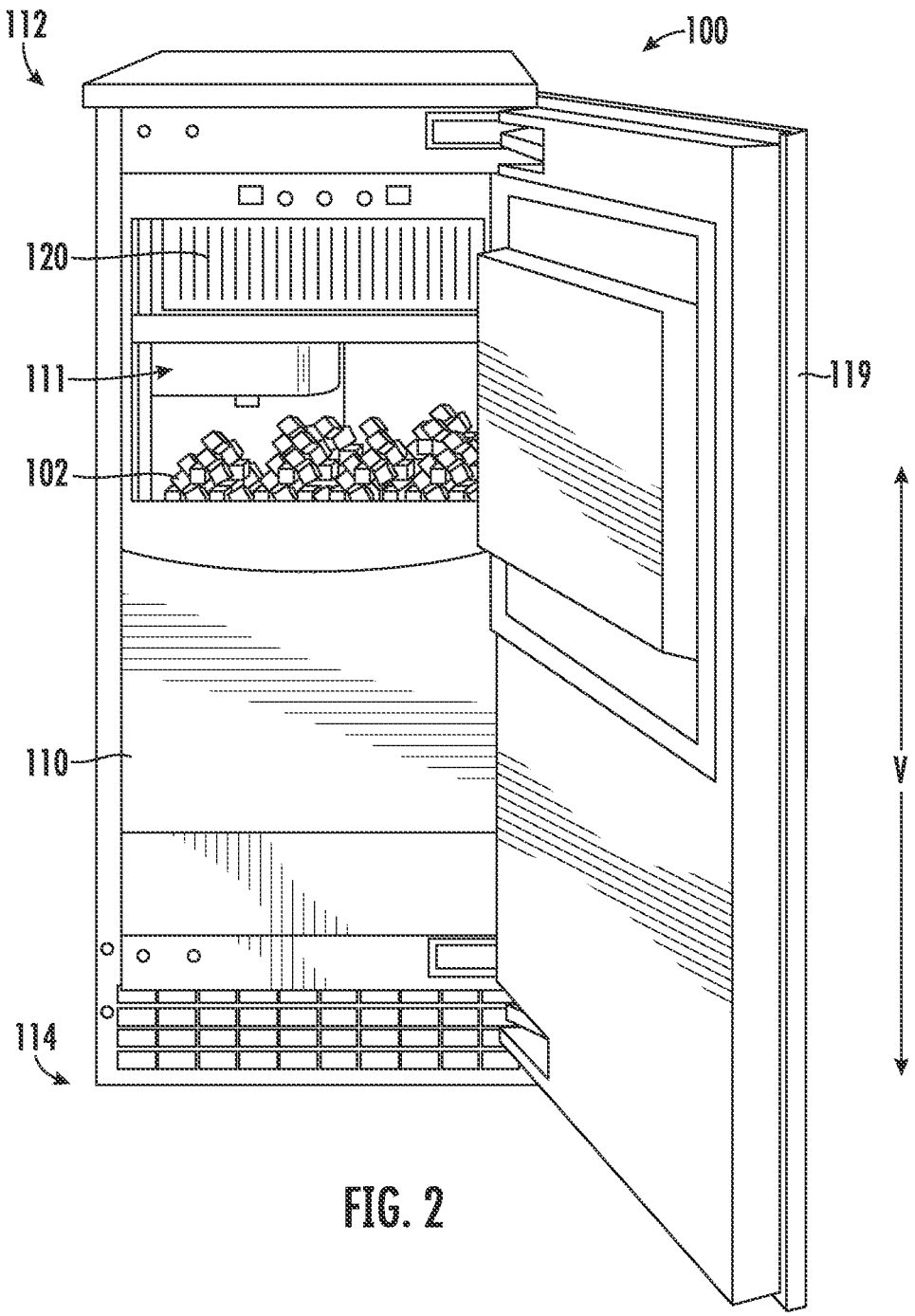
FIG. 2 provides a front, perspective view of the exemplary icemaker appliance of FIG. 1 with a door of the example icemaker appliance shown in an open position.

FIGS. 1 and 2 provide front, perspective views of an icemaker appliance 100 according to an example embodiment of the present subject matter. As discussed in greater detail below, icemaker appliance 100 includes features for generating or producing clear ice. Thus, a user of icemaker appliance 100 may consume clear ice stored within icemaker appliance 100. As may be seen in FIG. 1, icemaker appliance 100 defines a vertical direction V.

Icemaker appliance 100 includes a cabinet 110. Cabinet 110 may be insulated in order to limit heat transfer between an interior volume 111 (FIG. 2) of cabinet 110 and ambient atmosphere. Cabinet 110 extends between a top portion 112 and a bottom portion 114, e.g., along the vertical direction V. Thus, top and bottom portions 112, 114 of cabinet 110 are spaced apart from each other, e.g., along the vertical direction V. A door 119 is mounted to cabinet 110 at a front portion of cabinet 110. Door 119 permits selective access to interior volume 111 of cabinet 110. For example, door 119 is shown in a closed position in FIG. 1, and door 119 is shown in an open position in FIG. 2. A user may rotate door between the open and closed positions to access interior volume 111 of cabinet 110.

As may be seen in FIG. 2, various components of icemaker appliance 100 are positioned within interior volume 111 of cabinet 110. In particular, icemaker appliance 100 includes an ice maker 120 disposed within interior volume 111 of cabinet 110, e.g., at top portion 112 of cabinet 110. Ice maker 120 is configured for producing clear ice. Ice maker 120 may be configured for making any suitable type of clear ice. Thus, e.g., ice maker 120 may be a clear cube ice maker, as would be understood.

Icemaker appliance 100 may also include an ice storage compartment or storage bin 102. Ice storage compartment 102 may be provided within interior volume 111 of cabinet 110. In particular, ice storage compartment 102 may be positioned, e.g., directly, below ice maker 120 along the vertical direction V. Thus, ice storage compartment 102 is positioned for receiving clear ice from ice maker 120 and is configured for storing the clear ice therein. It will be understood that ice storage compartment 102 may be maintained at a temperature greater than the freezing point of water. Thus, the clear ice within ice storage compartment 102 may melt over time while stored within ice storage compartment 102. Icemaker appliance 100 may include features for recirculating liquid meltwater from ice storage compartment 102 to ice maker 120.

Figure 3:
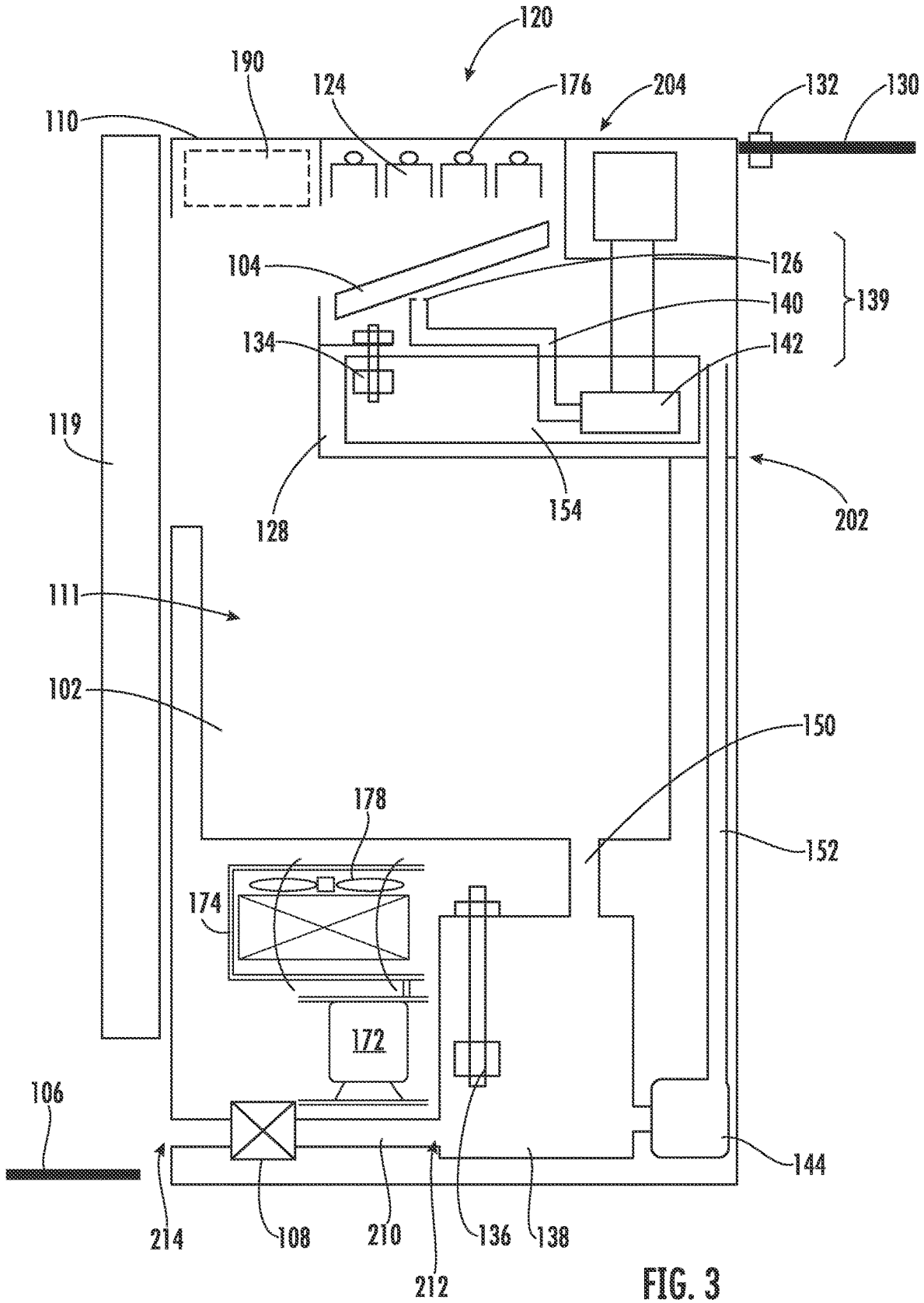
FIG. 3 provides a side schematic view of the exemplary icemaker appliance of FIG. 1 according to a first embodiment.

FIG. 3 provides a schematic view of certain components of icemaker appliance 100. As may be seen in FIG. 3, ice maker 120 may include an ice mold 124 and a nozzle 126. For instance, ice mold 124 may include a plurality of ice molds for forming a plurality of ice cubes at one time. Liquid from nozzle 126 may be dispensed toward ice mold 124. For example, nozzle 126 may be provided below ice mold 124 within a first reservoir 128 and may dispense liquid water upward toward ice mold 124. As discussed in greater detail below, ice mold 124 is cooled by refrigerant. Thus, the liquid water from nozzle 126 flowing across ice mold 124 may freeze on ice mold 124, e.g., in order to form clear ice cubes on ice mold 124.

To cool ice mold 124, icemaker appliance 100 includes a sealed system 170. Sealed system 170 includes components for executing a known vapor compression cycle for cooling ice maker 120 and/or air. The components include a compressor 172, a condenser 174, an expansion device (not shown), and an evaporator 176 connected in series and charged with a refrigerant. As will be understood by those skilled in the art, sealed system 170 may include additional components, e.g., at least one additional evaporator, compressor, expansion device, and/or condenser. Additionally or alternatively, the placement of the components (e.g., compressor 172, condenser 174, etc.) may be adjusted according to specific embodiments. Thus, sealed system 170 is provided by way of example only. It is within the scope of the present subject matter for other configurations of a sealed system to be used as well.

Within sealed system 170, refrigerant flows into compressor 172, which operates to increase the pressure of the refrigerant. This compression of the refrigerant raises its temperature, which is lowered by passing the refrigerant through condenser 174. Within condenser 174, heat exchange with ambient air takes place so as to cool the refrigerant. A fan 178 may operate to pull air across condenser 174 so as to provide forced convection for a more rapid and efficient heat exchange between the refrigerant within condenser 174 and the ambient air.

The expansion device (e.g., a valve, capillary tube, or other restriction device) receives refrigerant from condenser 174. From the expansion device, the refrigerant enters evaporator 176. Upon exiting the expansion device and entering evaporator 176, the refrigerant drops in pressure. Due to the pressure drop and/or phase change of the refrigerant, evaporator 176 is cool, e.g., relative to ambient air and/or liquid water. Evaporator 176 is positioned at and in thermal contact with ice maker 120, e.g., at ice mold 124 of ice maker 120. Thus, ice maker 120 may be directly cooled with refrigerant at evaporator 176.

It should be understood that ice maker 120 may be an air-cooled ice maker in alternative example embodiments. Thus, e.g., cooled air from evaporator 176 may refrigerate various components of icemaker appliance 100, such as ice mold 124 of ice maker 120. In such example embodiments, evaporator 176 is a type of heat exchanger which transfers heat from air passing over evaporator 176 to refrigerant flowing through evaporator 176, and fan may circulate chilled air from the evaporator 176 to ice maker 120.

Icemaker appliance 100 may also include a controller 190 that regulates or operates various components of icemaker appliance 100. Controller 190 may include a memory and one or more microprocessors, CPUs or the like, such as general or special purpose microprocessors operable to execute programming instructions or micro-control code associated with operation of icemaker appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Input/output ("I/O") signals may be routed between controller 190 and various operational components of icemaker appliance 100. As an example, the various operational components of icemaker appliance 100 may be in communication with controller 190 via one or more signal lines or shared communication busses.

Icemaker appliance 100 may include first reservoir 128. First reservoir 128 may be provided within ice storage compartment 102. For example, first reservoir 128 may be located at or near top portion 112 of interior volume 111 of ice storage compartment 102. First reservoir 128 may define a receiving space that holds liquid (e.g., water) to be formed into ice. For example, an inner volume of first reservoir 128 may be smaller than interior volume 111 of ice storage compartment 102. In some embodiments, first reservoir 128 may hold other liquids, such as cleaning solutions, for example. As will be explained in more detail below, first reservoir 128 may be removable (e.g., from ice storage compartment 102). For instance, first reservoir 128 may include detachable features with respect to cabinet 110, such as drawer slides, magnets, clips, or the like. Accordingly, first reservoir 128 may be removed from interior volume 111 of cabinet 110.

Ice maker 120 may be provided within first reservoir 128. In detail, evaporator 176 and ice mold 124 may be located within first reservoir 128. In some embodiments, ice maker 120 is provided above first reservoir 128 (e.g., along the vertical direction V). First reservoir 128 may extend along the vertical direction V from a bottom end 202 to a top end 204. Ice maker 120 may be mounted at the top end 204 of the first reservoir 128. For example, evaporator 176 may be mounted to the top end 204 and ice mold 124 may be connected to evaporator 176. In some embodiments, ice mold 124 may be defined by evaporator 176. In other words, evaporator 176 is integral with ice mold 124 such that the clear ice is formed directly on evaporator 176.

Icemaker appliance 100 may include a circulation system 139. Circulation system 139 may include a first pump 142, a circulation conduit 140, and a nozzle 126. First pump 142 may be provided within first reservoir 128. First pump 142 may pump water or liquid stored in first reservoir 128. Circulation conduit 140 may be connected to first pump 142 such that the water or liquid pumped by first pump 142 is circulated through circulation conduit 140. Circulation conduit 140 may include a series of tubes or pipes capable of guiding the water or liquid pumped by first pump 142. Nozzle 126 may be provided at a downstream end of circulation conduit 140. Nozzle 126 may dispense the water or liquid stored in first reservoir 128 toward ice maker 120 (i.e., ice mold 124 and/or evaporator 176).

In one embodiment, nozzle 126 may be located near bottom end 202 of first reservoir 128. As such, the water or liquid may be sprayed in a generally upward direction from nozzle 126 toward ice maker 120. Accordingly, clear ice may be formed on ice maker 120 due to a constant spray of water onto ice maker 120 while ice maker 120 is cooled by a circulation of refrigerant through sealed system 170. In detail, liquid dispensed from nozzle 126 may be directed toward ice mold 124. In some embodiments, a plurality of nozzles 126 may be provided. Each of the plurality of nozzles 126 may be connected to first pump 142 independently (e.g., each nozzle 126 having a dedicated circulation conduit 140). Additionally or alternatively, each of the plurality of nozzles 126 may be connected to the first pump 142 via a joint circulation conduit.

A first liquid level sensor 134 may be provided in first reservoir 128. Generally, the first liquid level sensor 134 may sense a level of liquid contained within first reservoir 128. In some embodiments, first liquid level sensor 134 is in operable communication with controller 190. For instance, first liquid level sensor 134 may communicate with the controller 190 via one or more signals. In certain embodiments, first liquid level sensor 134 includes a predetermined threshold level (e.g., to indicate the need for additional liquid to first reservoir 128). In particular, first liquid level sensor 134 may detect if or when the liquid first reservoir 128 is below the predetermined threshold level. Optionally, first liquid level sensor 134 may be a two-position sensor. In other words, first liquid level sensor 134 may either be "on" or "off," depending on a level of liquid.

For example, when the liquid level is below the predetermined threshold level, first liquid level sensor 134 is "off," meaning it does not send a signal to first pump 142 via controller 190 to pump liquid from first reservoir 128 through first circulation conduit 140 toward first nozzle 126. For another example, when the liquid level is above the predetermined threshold, first liquid level sensor 134 is "on," meaning it sends a signal to first pump 142 via controller 190 to operate first pump 142 to pump liquid through first circulation conduit 140 toward first nozzle 126. It should be understood that first liquid level sensor 134 may be any suitable sensor capable of determining a level of liquid within first reservoir 128, and the disclosure is not limited to those examples provided herein.

Icemaker appliance 100 may also be operated in a cleaning mode, or may perform a cleaning operation to clean the various pieces in icemaker appliance 100 that may become contaminated with foreign debris. For example, in some embodiments, cleaning solution or acid may be pumped through first circulation conduit 140 and dispensed by nozzle 126 toward ice maker 120. Accordingly, the cleaning solution or acid may remove the foreign contaminants or debris from, for example, ice mold 124, nozzle 126, first reservoir 128, and circulation conduit 140.

The icemaker appliance 100 may further include a second reservoir 138. The second reservoir 138 may be in fluid communication with the ice storage compartment 102. A drain conduit 150 may connect ice storage compartment 102 with second reservoir 138 such that liquid from ice storage compartment 102 flows into second reservoir 138. In some examples, second reservoir 138 is provided beneath ice storage compartment 102. In other words, second reservoir 138 may be below ice storage compartment 102 in the vertical direction V. Accordingly, liquid from ice storage compartment 102 may easily flow into second reservoir 138 via drain conduit 150. In one example, when ice stored within ice storage compartment 102 melts to water, at least a portion of the melt water may flow from ice storage compartment 102 through drain conduit 150 into second reservoir 138. The second reservoir 138 may also be in fluid communication with the first reservoir 128. In other words, liquid from second reservoir 138 may flow to first reservoir 128. In one example, the second reservoir 138 is connected to the first reservoir 128 via a return line conduit 152. During use, at least a portion of the melt water from second reservoir 138 may be pumped to first reservoir to be recirculated through first circulation conduit 140 and redispensed onto ice maker 120.

A second pump 144 may be provided at or in second reservoir 138. During use, second pump 144 may selectively pump at least a portion of the melt water from second reservoir 138 to first reservoir 128. Generally, second pump 144 may be provided as any suitable fluid pump (e.g., rotary pump, reciprocating pump, peristaltic pump, velocity pump, etc.). Optionally, second pump 144 may be an immersion pump and may be located within second reservoir 138. In detail, second pump 144 may be submersible within second reservoir 138 (i.e., within a volume of liquid stored within second reservoir 138). Additionally or alternatively, second pump 144 may be located outside of second reservoir 138.

In other words, second pump 144 may be outside the confines of second reservoir 138 such that second pump 144 is not in direct contact with liquid stored within second reservoir 138. Advantageously, second pump 144 may assist in recirculating liquid through icemaking appliance 100 to improve performance and reduce the need for cleaning or maintenance.

A second liquid level sensor 136 may be provided within second reservoir 138 to sense a level of liquid contained within second reservoir 138. Generally, the second liquid level sensor 136 may sense a level of liquid contained within second reservoir 138. In some embodiments, second liquid level sensor 136 is in operable communication with controller 190. For instance, second liquid level sensor 136 may communicate with the controller 190 via one or more signals. In certain embodiments, second liquid level sensor 136 includes a predetermined threshold level (e.g., to indicate the need to drain liquid from second reservoir 138). In particular, second liquid level sensor 136 may detect if or when the liquid in second reservoir 138 is below or above the predetermined threshold level. Optionally, second liquid level sensor 136 may be a two-position sensor. In other words, second liquid level sensor 136 may either be "on" or "off," depending on a level of water.

For example, when the water level is below the predetermined threshold level, second liquid level sensor 136 is "off" meaning it does not send a signal to second pump 144 via controller 190 to pump water from second reservoir 138. For another example, when the water level is above the predetermined threshold, second liquid level sensor 136 is "on," meaning it sends a signal to second pump 144 via controller 190 to operate second pump 144. It should be understood that second liquid level sensor 136 may be any suitable sensor capable of determining a level of liquid within second reservoir 138.

Icemaker appliance 100 may further include a cleanout line 210. Cleanout line 210 may define a first end 212 and a second end 214. Each of first end 212 and second end 214 defines a point along the flow path through the cleanout line 210. In one example, first end 212 is connected to second reservoir 138. For instance, first end 212 defines an outlet of second reservoir 138 where liquid exits second reservoir 138 and enters cleanout line 210. In some embodiments, first end 212 is defined at a side of second reservoir 138. However, first end 212 may be connected to or defined at a bottom, front, or rear of second reservoir 138. Accordingly, liquid within second reservoir 138 may flow out of second reservoir through cleanout line 210. Second end 214 may be open to an external area. In other words, second end 214 may be exposed outside of icemaker appliance 100. Liquid flowing through cleanout line 210 may be released from icemaking appliance 100 via second end 214. Second end 214 may be provided at a front panel of cabinet 110. In other words, second end 214 may be exposed at a front portion of icemaker appliance 100 (e.g., below door 119). Advantageously, each component within icemaking appliance 100 may be easily cleaned by circulating a cleaning fluid therethrough and draining the cleaning fluid through cleanout line 210. Thus, a more thorough cleaning may be performed resulting in cleaner ice, fewer maintenance issues, and overall increase in operability.

In some embodiments, an access panel 106 may be provided on cabinet 110. Access panel 106 may provide selective access to an interior of icemaker appliance 100. For instance, a user may remove or open access panel 106 to gain access to components of icemaker appliance 100 (e.g., sealed system 170, cleanout line 210, etc.) Access panel 106 may be located on a front portion of cabinet 110. For example, access panel 106 may be located beneath door 119. Access panel 106 may be attached to cabinet 110 via a hinge. Accordingly, access panel 106 may be opened to allow access to second end 214 of cleanout line 210. Additionally or alternatively, access panel 106 may be removable from cabinet 110. A user may be able to completely remove access panel 106 from cabinet 110 in order to expose second end 214 to the ambient atmosphere outside of icemaking appliance 100.

A valve (e.g., cleanout valve) 108 may be connected to cleanout line 210. Valve 108 may be fluidly coupled to cleanout line 210 to allow cleanout line 210 to be open (e.g., allow fluid to flow through cleanout line 210) or closed (e.g., restrict fluid from flowing through cleanout line 210). The valve 108 may be selectively opened and closed to allow liquid to be released from second reservoir 138. The valve 108 may be any suitable valve, such as a mechanical valve or an electromechanical valve, for example. Optionally, the valve 108 may be in operable communication with controller 190. In some such embodiments, the valve 108 is selectively controlled by controller 190 (e.g., opened or closed according to a signal received from controller 190). For example, a user may select an operation in which the controller 190 directs the valve 108 to open for release liquid from second reservoir 138. Additionally or alternatively, a user may manually open the valve 108 and place a tray or bucket in front of the second end 214 of cleanout line 210 to collect liquid released from second reservoir 138.

A perforated ramp or series of slats 104 may be provided above the first reservoir 128 (e.g., along the vertical direction V). The ramp 104 may be located beneath the ice maker 120 (e.g., beneath the ice mold 124 or evaporator 176). In other words, ramp 104 may be located under ice maker 120 along the vertical direction V. A top surface of the ramp 104 (or top edges of the series of slats) may be angled. In other words, a first end of ramp 104 may be positioned higher in the vertical direction V than a second end of ramp 104. Thus, when ice is formed on ice maker 120 and harvested, the ice may fall onto ramp 104 and slide into ice storage compartment 102. In one example, as seen in FIG. 3, the ramp 104 is angled downward toward a front of cabinet 110. Accordingly, a passageway or hole may be provided on a side of first reservoir 128 through which the ice cubes may be ejected after sliding down ramp 104.

The ice maker 102 may further include a heater (not shown) provided at or near ice mold 124. During a harvesting of the ice cubes formed on ice mold 124, the heater may be activated to heat ice mold 124 and subsequently release the ice cubes from ice mold 124. In one embodiment, the sealed system 170 may be turned off (i.e., no refrigerant is supplied to evaporator 176) and the heater may be turned on for a predetermined amount of time. Ice mold 124 is then temporarily heated by the heater to release or harvest the ice cubes. The heater may be an electric heater, for example. However, it should be understood that various types of heaters may be used to heat ice mold 124, including a reverse flow of refrigerant through sealed system 170, for another example, and the disclosure is not limited to those examples provided herein.

Icemaker appliance 100 may include a water supply conduit 130 and a supply valve 132. Water supply conduit 130 is connectable to an external pressurized water supply, such as a municipal water supply or well. Supply valve 132 may be coupled to water supply conduit 130, and supply valve 132 may be operable (e.g., openable and closable) to regulate liquid water flow through water supply conduit 130 into icemaker appliance 100. In one embodiment, water supply conduit 130 is connected to first reservoir 128. In detail, water supply conduit 130 is in fluid communication with first reservoir 128 to allow external water to be supplied into first reservoir 128 via water supply conduit 130. Thus, e.g., first reservoir 128 may be filled with fresh liquid water from the external pressurized water supply through water supply conduit 130 by opening supply valve 132. Water supply conduit 130 may be connected at a bottom of cabinet 110. In some embodiments, water supply conduit 130 is connected at a top of cabinet 110. According to this embodiment, water introduced through a top of the cabinet may be released over top of ice maker 120 and may assist in a harvesting operation of ice formed on ice mold 124.

Icemaker appliance 100 may include a filter 154. Filter 154 may be nested within first reservoir 128. For instance, filter 154 may rest within first reservoir 128. In some embodiments, filter 154 is suspended within first reservoir 128. In detail, a space for receiving liquid having passed through filter 154 may be provided between an underside of filter 154 and a bottom of first reservoir 128. Filter 154 may thus be located beneath ice mold 124. For instance, filter 154 may be positioned such that the liquid dispensed from nozzle 126 that does not freeze on ice mold 124 may fall on top of filter 154. Accordingly, filter 154 may be a gravity style filter. In detail, liquid may fall onto a top of filter 154, seep through filter 154 (e.g., along the vertical direction V), and exit through a bottom of filter 154.

Figure 4:
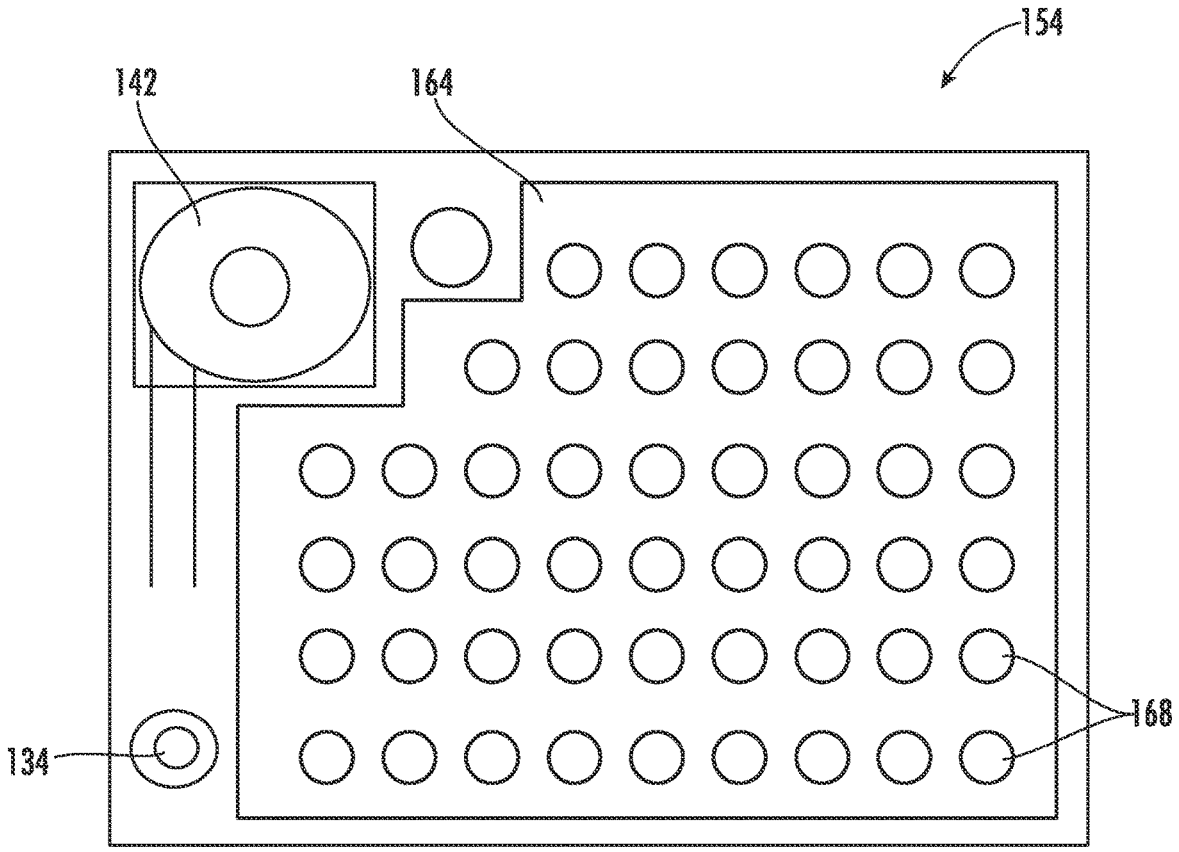
FIG. 4 provides a top schematic view of the exemplary replaceable filter of FIG. 3 according to one embodiment.
Figure 5:
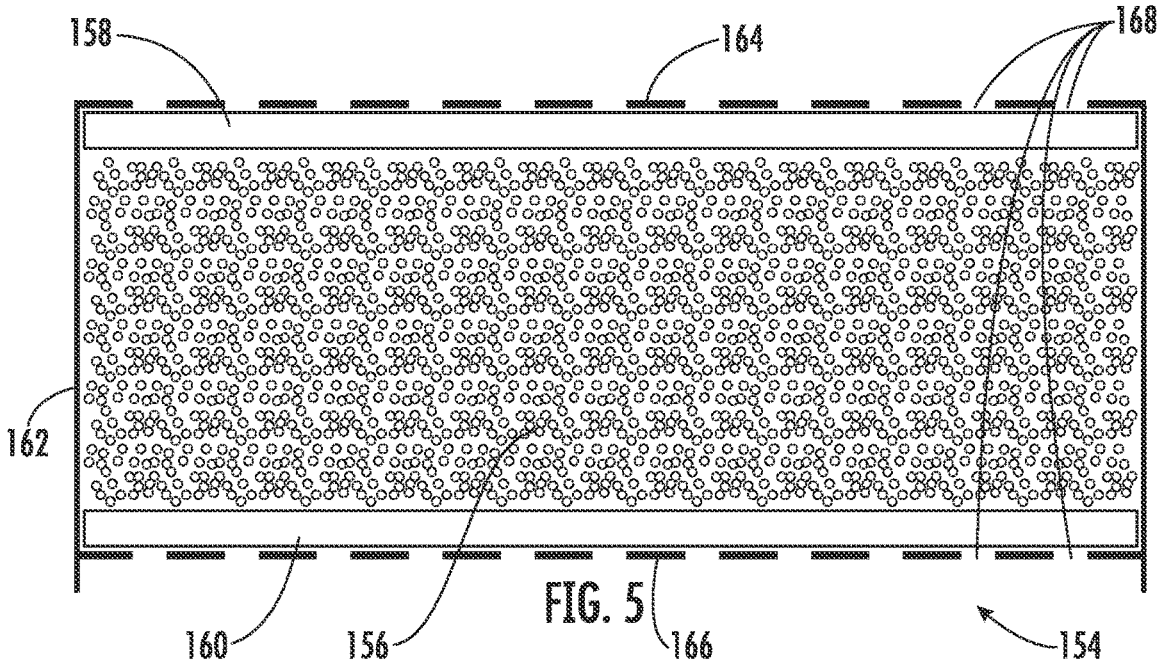
FIG. 5 provides a side schematic view of the exemplary replaceable filter of FIG. 3 according to one embodiment.

FIGS. 4 and 5 provide top and side schematic views of filter 154. Referring to FIGS. 4 and 5, filter 154 may include a filter casing 162 and a filter medium 156. Filter casing 162 may be a hexahedron that encases filter medium 156. For instance, filter casing 162 may include a top plate 164 and a bottom plate 166. Top plate 164 and bottom plate 166 may be opposite each other (e.g., along the vertical direction V). In some embodiments, when filter 154 is positioned within first reservoir 128, top plate 164 and bottom plate 166 each extend in the lateral direction L and the transverse direction T. Thus, the liquid dripping from ice mold 124 may fall onto top plate 164 to enter filter casing 162 and may fall through bottom plate 166 to exit filter casing 162. As mentioned above, first reservoir 128 may be removable (e.g., from cabinet 110). Accordingly, filter 154 may be easily removed (e.g., for cleaning or replacement) from first reservoir 128).

Top plate 164 and bottom plate 166 may each include a plurality of openings 168 formed therethrough. For instance, openings 168 may be formed along the vertical direction V through each of top plate 164 and bottom plate 166. Accordingly, the liquid may enter filter casing 162 through the plurality of openings 168 in top plate 164 and may exit filter casing 162 through the plurality of openings 168 in bottom plate 166. A size and shape of openings 168 may vary according to specific embodiments. For instance, each opening 168 may have a circular cross-section. However, the disclosure is not limited to this, and a cross-section of each opening may be triangular, quadrilateral, hexahedral, or the like. Similarly, a spacing between each opening 168 may vary according to specific embodiments. It should be understood that the representation of the plurality of openings 168 in FIGS. 4 and 5 is merely exemplary, and the disclosure is not limited to those embodiments shown.

Filter medium 156 may include a first layer 158, a second layer 160, and a resin provided between the first and second layers 158 and 160. For example, filter 154 may be a deionization filter (e.g., a gravity deionization filter). Accordingly, the resin may be a deionization resin. Additionally or alternatively, first layer 158 and second layer 160 may be liquid porous filtration material. In detail, liquid (e.g., water) may seep through first layer 158, interact with the resin, and seep through second layer 160. Accordingly, the liquid may be filtered by each of first layer 158, second layer 160, and the resin. After having been filtered, the liquid may exit filter casing 162 (e.g., through openings 168 in bottom plate 166) via gravity. The filtered liquid may then be collected within first reservoir 128 to be resupplied to ice mold 124 through nozzle 126.

Figure 6:
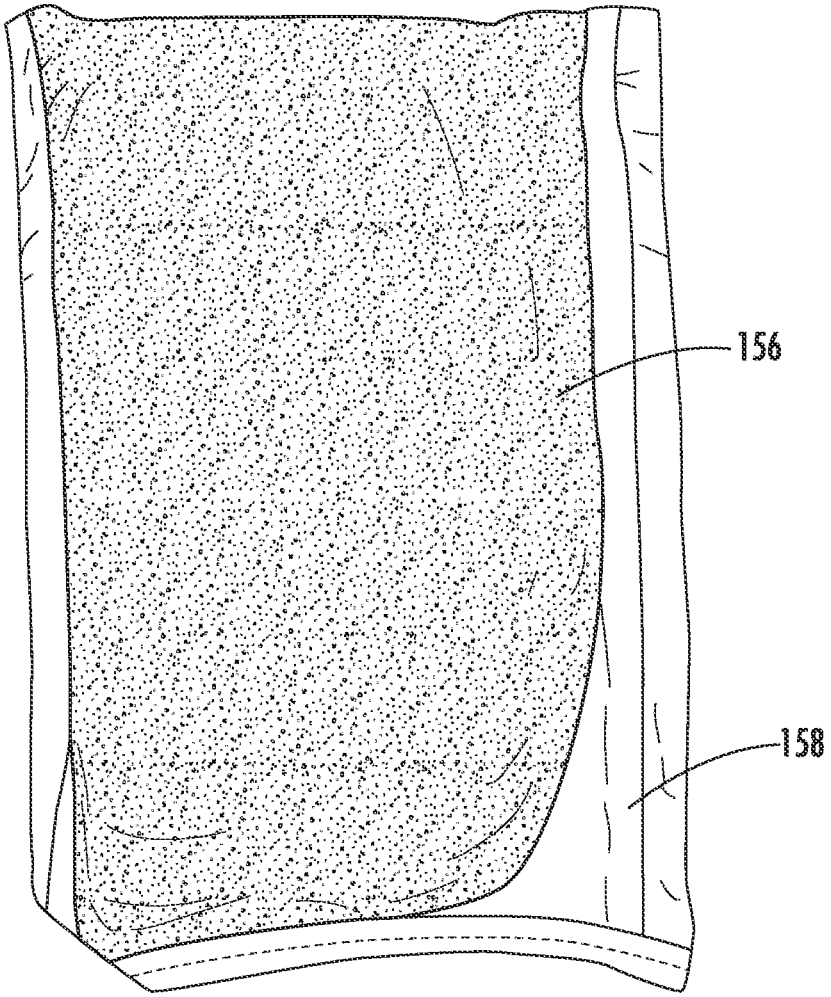
FIG. 6 provides a top schematic view of the exemplary replaceable filter of FIG. 3 according to another embodiment.

In some embodiments, filter casing 162 may be omitted. For instance, with reference to FIG. 6, first layer 158 and second layer 160 may be fused together to enclose the resin therein (e.g., as a filter bag). In detail, edges of first layer 158 and second layer 160 may be sealed shut to restrict the resin from escaping into first reservoir 128. In one example, first layer 158 and second layer 160 may be a polyester bag (i.e., each of first and second layers 158, 160 may have a porosity of about 100 microns). According to this embodiment, the filter bag (first layer 158, second layer 160, resin) may be placed directly in first reservoir 128. In alternate embodiments, the filter bag (first layer 158, second layer 160, resin) may be placed within filter casing 162.

Figure 7:
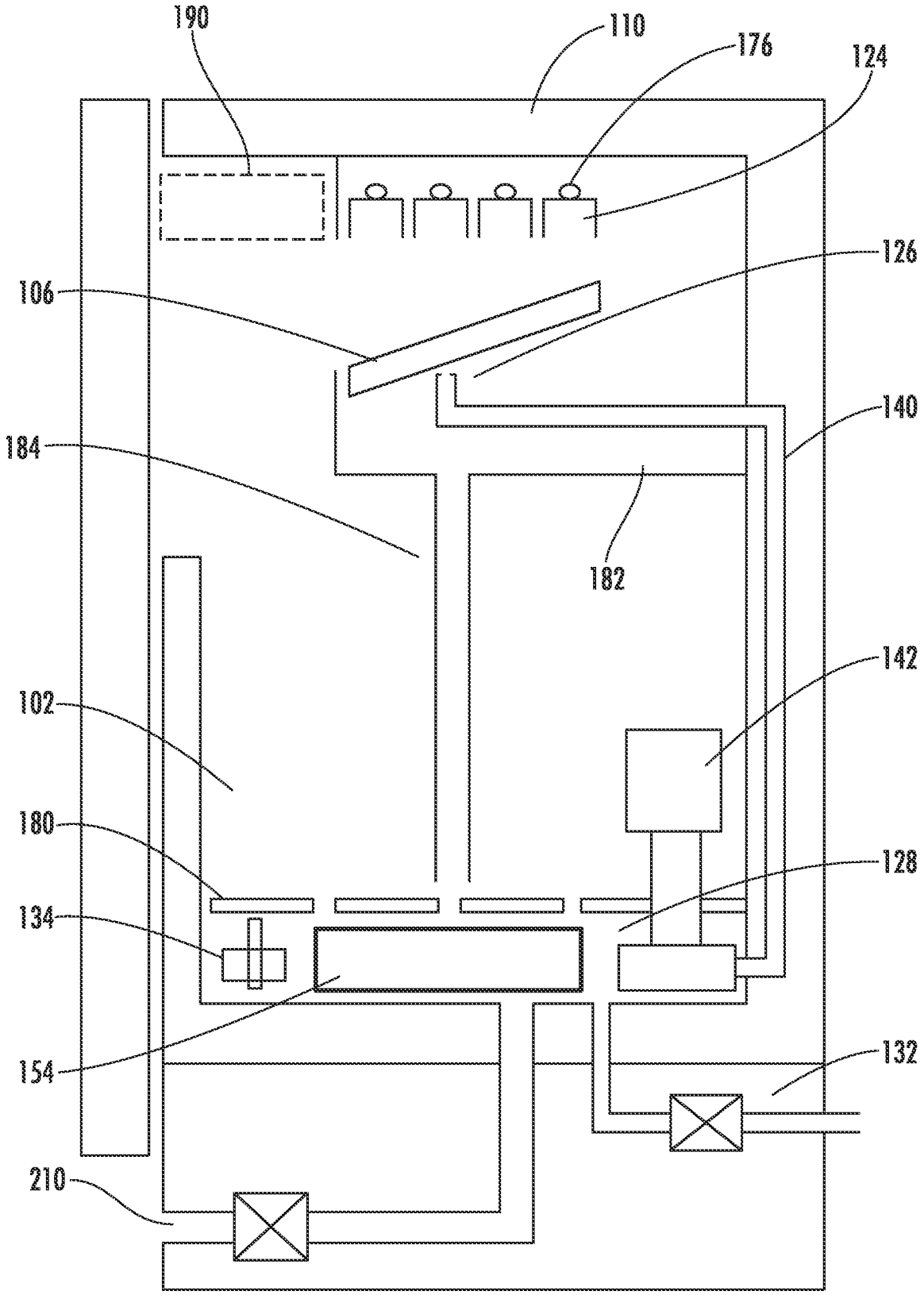
FIG. 7 provides a side schematic view of the exemplary icemaker appliance of FIG. 1 according to another embodiment.

FIG. 7 provides a side schematic view of an icemaker appliance according to an alternate embodiment. According to FIG. 7, first reservoir 128 may be provided below ice storage compartment 102. For instance, first reservoir 128 may be located immediately beneath ice storage compartment 102. A grate 180 may be provided to separate ice storage compartment 102 from first reservoir 128. Grate 180 may be a removable grate. For instance, a user may pull grate 180 out from ice storage compartment 102 to gain access to first reservoir 128. Accordingly, the user may be able to easily remove filter 154 from first reservoir 128. Additionally or alternatively, each of second reservoir 138 and second pump 144 may be omitted. Advantageously, fewer parts may be incorporated and an increase in ice storage space (e.g., a larger ice storage compartment 102) may be realized. According to this embodiment, cleanout line 210 may be in direct fluid communication with first reservoir 128. In detail, first end 212 of cleanout line 210 may be attached to first reservoir 128.

Further, icemaker appliance 100 according to FIG. 7 may include a collection tray 182. Collection tray 182 may be provided beneath ice mold 124. In detail, collection tray 182 may collect the liquid that drips from ice mold 124 during and after an icemaking operation (e.g., when liquid is dispensed from nozzle 126 toward ice mold 124). Additionally or alternatively, a return line 184 may be provided. Return line 184 may be connected to collection tray 182 (e.g., at a bottom of collection tray 182). Return line may extend along the vertical direction V from collection tray 182 toward grate 180. Thus, the liquid collected in collection tray 182 may be returned to first reservoir 128 and resupplied to filter 154.

Figure 8:
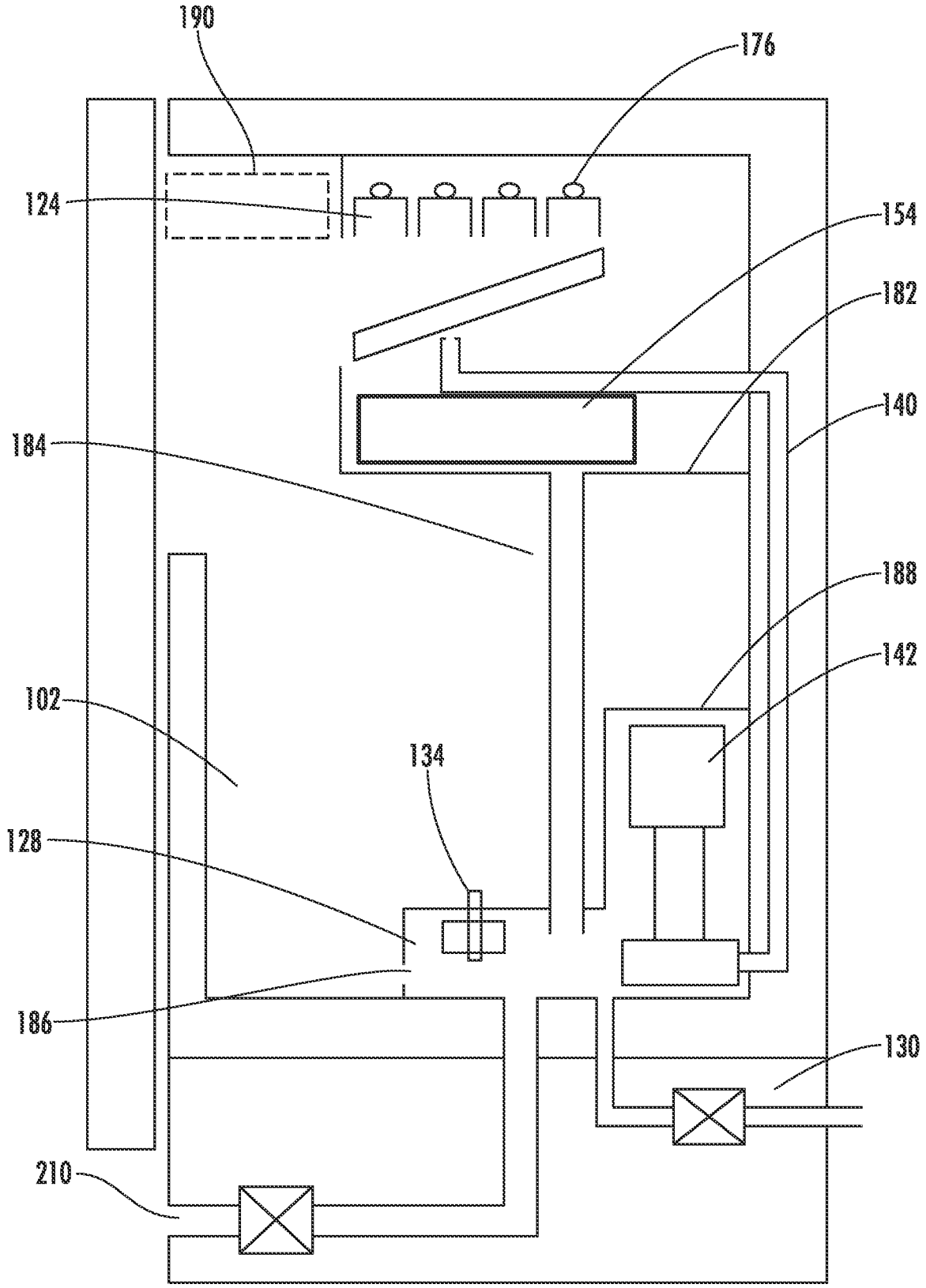
FIG. 8 provides a side schematic view of the exemplary icemaker appliance of FIG. 1 according to another embodiment.

FIG. 8 provides a side schematic view of an icemaker appliance according to yet another alternate embodiment. According to FIG. 8, first reservoir 128 is provided at or near a bottom of ice storage compartment 102 (e.g., interior volume 111) along the vertical direction V. In detail, first reservoir 128 may include a reservoir cover 188. Reservoir cover 188 may encompass first pump 142 and first liquid level sensor 134. Reservoir cover 188 may separate first reservoir 128 from ice storage compartment 102. Further, reservoir cover 188 may define a meltwater hole 186. Meltwater hole 186 may be located at or near a bottom of reservoir cover 188 (e.g., along the vertical direction V). In detail, as ice cubes collected in ice storage compartment 102 melt, the meltwater may flow from ice storage compartment 102 into first reservoir 128 to be resupplied to ice mold 124 (e.g., by nozzle 126).

Further, icemaker appliance according to FIG. 8 may include collection tray 182. Similar to the embodiment of FIG. 7, collection tray 182 may be provided beneath ice mold 124 to collect liquid from ice mold 124. However, according to this embodiment, filter 154 may be provided in collection tray 182 as opposed to first reservoir 128. Additionally or alternatively, filter 154 may be provided beneath ice mold 124. As such, the liquid collected from ice mold 124 may flow through filter 154 upon dripping from ice mold 124. Return line 184 may be in fluid communication with collection tray 182 and first reservoir 128. In detail, return line 184 may extend along the vertical direction V between collection tray 182 and first reservoir 128. Thus, the liquid collected by collection tray 182 may be supplied directly back into first reservoir 128 via return line 184 after having passed through filter 154.

Moreover, similar to the embodiment of FIG. 7, each of second reservoir 138 and second pump 144 may be omitted. Advantageously, fewer parts may be incorporated and an increase in ice storage space (e.g., a larger ice storage compartment 102) may be realized. According to this embodiment, cleanout line 210 may be in direct fluid communication with first reservoir 128. In detail, first end 212 of cleanout line 210 may be attached to first reservoir 128. Additionally or alternatively, incorporating a gravity filter eliminates the need for a plumbed filter to be added to circulation system 139. Accordingly, a required pump pressure may be reduced, in turn reducing operating and material/equipment costs.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "coupled," "fixed," "attached to," and the like refer to both direct coupling, fixing, or attaching, as well as indirect coupling, fixing, or attaching through one or more intermediate components or features, unless otherwise specified herein. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker appliance defining a vertical direction, a lateral direction, and a transverse direction, the icemaker appliance comprising:
- a cabinet forming an ice storage compartment;
- an ice mold provided within the cabinet;
- a first reservoir provided below the ice mold and configured for collecting liquid from the ice mold;
- a filter nested within the first reservoir, wherein the filter is suspended above a bottom of the first reservoir; and
- a circulation system in fluid communication with the first reservoir, the circulation system comprising:
  - a circulation conduit;
  - a first pump connected to the circulation conduit to pump the liquid through the circulation conduit; and
  - a nozzle downstream from the circulation conduit to dispense the liquid from the circulation conduit, wherein a first portion of the liquid dispensed from the nozzle falls onto the filter such that the first portion of the liquid that enters the filter enters only through a top of the filter.

2. The icemaker appliance of claim 1, wherein the filter is a gravity deionization filter through which the liquid is filtered along the vertical direction from the top to a bottom.

3. The icemaker appliance of claim 2, wherein the filter comprises:
- a first layer of liquid porous filtration material;
- a second layer of liquid porous filtration material opposite the first layer of liquid porous filtration material;
- a deionization resin provided between the first and second layers of liquid porous filtration material; and
- a filter casing enclosing the first and second layers of liquid porous filtration material and the deionization resin.

4. The icemaker appliance of claim 3, wherein the filter casing comprises:
- a top plate defining a plurality of first openings through which the liquid flows into the filter casing and over the first layer of liquid porous filtration material; and
- a bottom plate defining a plurality of second openings through which the liquid flows out of the filter casing.

5. The icemaker appliance of claim 3, wherein the first layer of liquid porous filtration material and the second layer of liquid porous filtration material are fused together to encapsulate the deionization resin therein.

6. The icemaker appliance of claim 1, further comprising:

a second reservoir in fluid communication with the ice storage compartment and the first reservoir;

a return line conduit connected between the first reservoir and the second reservoir, the return line conduit directing liquid from the second reservoir to the first reservoir; and a second pump provided at the second reservoir to pump the liquid through the return line conduit.

7. The icemaker appliance of claim 6, wherein the second reservoir is provided below the ice storage compartment.

8. The icemaker appliance of claim 6, wherein the second reservoir is provided within the ice storage compartment.

9. The icemaker appliance of claim 6, further comprising:

a cleanout line having a first end connected to the second reservoir and a second end exposed outside of the cabinet; and a cleanout valve provided on the cleanout line to selectively open and close the cleanout line.

10. The icemaker appliance of claim 1, further comprising a sealed cooling system, the sealed cooling system having an evaporator positioned at the ice mold.

11. The icemaker appliance of claim 10, wherein the first reservoir is removable and extends along the vertical direction from a bottom end to a top end, and wherein the evaporator is mounted at the top end.

12. The icemaker appliance of claim 1, further comprising a water supply conduit and a supply valve, the water supply conduit connectable to an external water supply, the supply valve connected to the water supply conduit to regulate liquid water flow through the water supply conduit into the icemaking appliance.

13. An icemaker appliance defining a vertical direction, a lateral direction, and a transverse direction, the icemaker appliance comprising:

a cabinet forming an ice storage compartment;

a first reservoir provided within the ice storage compartment, the first reservoir configured to receive a liquid;

a removable grate located within the ice storage compartment over the first reservoir;

an ice maker provided within the ice storage compartment to produce ice;

a filter nested within the first reservoir, wherein the liquid within the first reservoir permeates through the filter, and wherein the filter is suspended above a bottom of the first reservoir; and a circulation system in fluid communication with the first reservoir, the circulation system comprising:

a circulation conduit;

a pump connected to the circulation conduit to pump liquid from the first reservoir through the circulation conduit; and a nozzle downstream from the circulation conduit to dispense the liquid from the circulation conduit toward the ice maker, wherein a first portion of the liquid dispensed from the nozzle falls onto the filter such that the first portion of the liquid that enters the filter enters only through a top of the filter.

14. The icemaker appliance of claim 13, wherein the filter is a gravity deionization filter through which the liquid is filtered along the vertical direction from the top to a bottom.

15. The icemaker appliance of claim 14, wherein the filter comprises:

a first layer of liquid porous filtration material;

a second layer of liquid porous filtration material opposite the first layer of liquid porous filtration material;

a deionization resin provided between the first and second layers of liquid porous filtration material; and a filter casing enclosing the first and second layers of liquid porous filtration material and the deionization resin.

16. The icemaker appliance of claim 15, wherein the filter casing comprises:

a top plate defining a plurality of first openings through which the liquid flows into the filter casing and over the first layer of liquid porous filtration material; and a bottom plate defining a plurality of second openings through which the liquid flows out of the filter casing.

17. The icemaker appliance of claim 15, wherein the first layer of liquid porous filtration material and the second layer of liquid porous filtration material are fused together to encapsulate the deionization resin therein.

18. The icemaker appliance of claim 13, further comprising a collection tray provided within the ice storage compartment above the first reservoir and below the ice maker, the collection tray configured for collecting liquid.

19. The icemaker appliance of claim 18, further comprising a return line connected to the collection tray, the return line directing liquid from the collection tray to the first reservoir.

20. The icemaker appliance of claim 13, wherein the ice maker comprises a sealed cooling system and ice mold, the sealed cooling system having an evaporator positioned at the ice maker.

* * * * *